US007013502B2

(12) United States Patent
Pacheco

(10) Patent No.: US 7,013,502 B2
(45) Date of Patent: Mar. 21, 2006

(54) BIDET

(76) Inventor: Manuel A Pacheco, P.O. Box 9, Sterling, MA (US) 01564

( * ) Notice: Subject to any disclaimer, the term of this patent is extended or adjusted under 35 U.S.C. 154(b) by 0 days.

(21) Appl. No.: 10/694,514

(22) Filed: Oct. 27, 2003

(65) Prior Publication Data

US 2005/0086729 A1 Apr. 28, 2005

(51) Int. Cl.
*A61H 35/00* (2006.01)

(52) U.S. Cl. ..... 4/420.2; 4/420.4; 4/448

(58) Field of Classification Search ..... 4/420.2, 4/420.4, 448
See application file for complete search history.

(56) References Cited

U.S. PATENT DOCUMENTS 1,866,930 A * 7/1932 Guidetti et al. ..... 4/420.2
4,926,509 A * 5/1990 Bass ..... 4/448
5,384,919 A * 1/1995 Smith ..... 4/448
5,960,484 A * 10/1999 Shao ..... 4/420.4
6,167,577 B1 * 1/2001 Hammad ..... 4/420.4

* cited by examiner

*Primary Examiner*—Robert M. Fetsuga
(74) *Attorney, Agent, or Firm*—James F. Baird

(57) ABSTRACT

This is a Bidet with a variable position removable spray nozzle, a spring activated means to withdraw the spray nozzle from the normal area of use when not in use, a means to provide variable pressure of spray, a means for mixing input hot water with input cold water to allow for adjustable water temperature within a controlled range, a means for adjusting the water pressure and volume within a controlled range, a vacuum breaker to prevent water backflow, and a diverter T for selectively adding substances that are either scented, anti bacterial, medicated or cleansing agent to spray, and in addition preventing water backflow.

3 Claims, 6 Drawing Sheets

BIDET

BACKGROUND

The field of my invention is Bidets of the type typically found in home bathrooms. The invention portrayed is an improved Bidet. There are many Bidets that have been manufactured over the years, from the simple hand held spray wand to the more elaborate. The present invention is an improved Bidet that overcomes several problems. My invention permits the Bidet to be used in conjunction with a toilet as found in most household bathrooms. In some Bidets that are on the market the spray comes from a nozzle that can be operated from only one fixed position. This may be acceptable for most applications however, many users have peculiar situations requiring aiming the nozzle and therefore the spray at a specific area or areas. Several Bidets have spray nozzles that cannot be easily removed for cleaning or replacement. The present invention incorporates a variable position arm with removable spray nozzle. The variable position arm may be attached, to the toilet bowl with a clamp, or to the underside of the toilet seat with a bracket. The variable position arm has an easily accessible hand operated lever that allows the user to position the spray nozzle in a wide range of lateral positions above the toilet bowl and below the toilet seat, the positions form an arc. The user may adjust the arc to the most desired position by moving the clamp on the toilet bowl or by adjusting the position of the bracket on the underside of the toilet seat. Once the clamp or bracket are in position it would still be possible make future adjustments. The variable position arm initially would be positioned with the spray nozzle in a non-use position that would have the spray nozzle immediately adjacent to the inner rim of the toilet bowl and under the toilet seat. The variable position arm may also be attached to a spring, the spring would act to keep the spray nozzle in the non-use position. The spring would be extended when the hand operated lever is used to position the spray nozzle for use. Upon release of the hand operated lever the spring will withdraw the variable position arm and the spray nozzle from the normal area of use. My invention also incorporates: a means to provide variable pressure of spray within a safe range; a means for adjusting water volume within a controlled range; a means for mixing input hot water with input cold water to allow for adjustable water temperature within a controlled range; a vacuum breaker to prevent water back flow; and a diverter T for selectively adding substances that are scented, anti bacterial, medicated or cleansing agent to the spray. The diverter T also acts to prevent water back flow.

The present invention provides an improved Bidet that is both easy to use and inexpensive to manufacture.

An object of the invention is to provide a Bidet with wand, having a removable spray nozzle, that may be easily moved from one position during use and to another for storage when not in use.

A further object of the invention is provide a Bidet that allows for variable water pressure and volume within a safe range.

Another object of the invention is to incorporate a means for mixing hot and cold input water with a resulting temperature within a controlled safe temperature range.

A still further object of the invention is to incorporate a vacuum breaker to prevent water back flow.

An additional object of the invention is to incorporate a diverter T to permit the selective addition of substances, that are either scented, anti bacterial, medicated or cleansing agent, to the spray.

A yet further object of the invention is to incorporate a diverter T that prevents water back flow.

DESCRIPTION OF THE PREFERRED EMBODIMENT

Turning first to FIG. 1 there is shown the present invention, Bidet, in a partially assembled configuration. Shown are removable spray nozzle 1, that is removably mounted on a tubular spray arm 2. The spray nozzle could have male threads at the tubular spray arm end with female threads on the tubular spray arm, or the spray nozzle could be frictionally secured to the tubular spray arm. There are other methods of attachment that could be used that would permit secure, but not permanent, attachment and at the same time ease of removal. The tubular spray arm is formed of a tubular member 2, having a first end 19, a second end 20, and a mid section 21. Said tubular member is shaped to accommodate the curvature of a toilet bowl and seat. In the preferred embodiment the spray nozzle is sized and shaped to be frictionally secured onto the tubular member first end. The tubular spray arm 2 has a spring activated bracket 3, shown in a disassembled configuration. The spring activated bracket 3 is comprised of a mounting plate, or second bracket section 23 that would be used to secure the bracket to the underside of a conventional toilet seat, a washer, a pin, a spray arm plate or first bracket section 22 fixedly secured to the spray arm and a spring. The pin is situated in order that the pin goes thru a hole in the mounting plate and a hole in the spray arm plate forming an axis of rotation for the spray arm plate. The spring activated bracket 3 would be mounted to the underside of a conventional toilet seat portion of a conventional toilet bowl as shown at FIG. 6. The mounting to the underside of the conventional toilet seat could make use of a bolt or pin for quick removal. The spring portion of the spring activated bracket 3 extends as the tubular spray arm 2 is moved to place the spray nozzle 1 in the area of intended use, causing tension on the spring, and returns the tubular spray arm 2 to an out of the way position under the seat or against the side of the toilet bowl when the tubular spray arm is released and not in use. The removable spray nozzle 1 allows for cleaning and sanitation of the removable spray nozzle 1 without any time consuming or complicated procedure. As the removable spray nozzle 1 is easily removable it is also possible to have several spray nozzles with different spray patterns to accommodate the users individual preference. It also allows for unique requirements due to the individual's personal physical or medical requirements.

The pivotal mounting of the tubular spray arm 2, at the spring activated bracket 3, allows for individual needs or preferences of the user as to spray location. With a spring activated bracket 3 the tubular spray arm 2 and removable spray nozzle 1 are quickly and safely removed from the spray area when not in use. The first end of the spring is attached to the portion of the spring activated bracket that is secured to the underside of the toilet seat with the second end of the spring being attached to the portion of the spring activated bracket that is fixedly secured to the tubular spray arm. The spring is sized and shaped in order that the spring tension causes the tubular spray arm to remain in an inactive position unless pressure is applied to the tubular spray arm causing the tubular spray arm to swing into the active position. The tension of the spring when in the active position is such that the user is not required to apply an inordinate amount of force.

The invention provides for an adjustable spray pressure and volume. The invention provides a means in order that the pressure and volume of the spray may be adjusted to not exceed a maximum safe limit. In this embodiment a set screw 6 is used however it would be practical to use another means to adjust the volume and pressure, or two means to adjust the volume and pressure separately. The component elements of the invention are capable of withstanding a maximum pressure of 125 psi. In some installations the supply line pressure may exceed safe limits for direct skin contact, or may fluctuate and from time to time exceed the safe limit. The present invention incorporates a set screw 6 to control the pressure, the set screw 6 also acts to control the volume. The ability to adjust the volume allows the user to vary the volume to suit the users particular requirements. The movement of the set screw 6 is restricted to insure that the pressure will not exceed 70 psi.

The invention includes a spring loaded self closing valve 4 to insure that the flow of water stops when not in use or in the event the user's attention is diverted. In order for there to be any flow of water the valve handle must be depressed. The spring loaded self closing valve could be an off the shelf item.

Water temperature is also of major importance to insure that the users skin is not exposed to water that exceeds safe limits. The present invention provides a mixing valve 7, shown in FIG. 2, that combines the input hot water with the input cold water. The mixing valve 7 is designed to restrict the combined water temperature to be no more than 110° F. This reduces the possibility of injury due to fluctuating temperature of the input hot water. The mixing valve has an adjustment knob that permits the varying of the ratio of hot water to cold water from a ratio were no hot water is entering the valve with the resultant combined outlet water being the temperature of the cold water to a ratio were sufficient hot water is entering the valve with the resultant combined outlet water being no more than 110° F. The mixing valve would be a standard off the shelf item.

A vacuum breaker 5 is incorporated to insure that there is no possibility of backflow of the spray water into the water supply. The backflow could carry contaminated water to other outlets in the building or even outside the building, the vacuum breaker 5 prevents any such backflow. The vacuum breaker 5 also insures that water on the spray nozzle side of the vacuum breaker 5 cannot reenter the water supply. The vacuum breaker has an inlet fitting 24 and an outlet fitting 25. The vacuum breaker would be an off the shelf item.

Also incorporated is a diverter T 8 that permits the addition of various substances at an injection port 9 into the spray water. The substances would usually be in liquid form however it would be possible to add dissolvable crystals, cubes or gels. The substance being added could be scented, anti bacterial, medicated or a cleansing agent. The diverter T 8 also prevents water backflow. Conventional supply lines provide hot and cold water to the mixing valve 7 which then supplies the combined hot and cold water to the bidet. A double hose service hose 11 is used to pass the water thru the vacuum breaker 5 and also the diverter T 8.

FIG. 4 shows a side cutaway view of the diverter T 8 indicating how the internal cavities causes the water to flow in from the self closing valve 4 at the primary inlet "a", the water is then diverted to the vacuum breaker 5 at the primary outlet "b", by means of the double hose service hose 11, the water then flows back from the vacuum breaker 5 at the secondary inlet "c", by means of the double hose service hose 11, allowing for the addition of various substances at the injection port 9 the water then flows to the tubular spray arm 2 at the secondary outlet "d".

As shown several the components may be connected by the use of threaded joints, including the tubular spray arm and spray nozzle .for increased ease in removal and replacement.

FIG. 5 shows a cut away view of the self closing valve 4 joined to the diverter T 8. The self closing valve with an internal cavity, an inlet, an outlet and an activation means, said activation means being a spring, a plurality of washers, a plunger, a pivoting handle, and a range of movement restricting set screw, said pivoting handle may be depressed or released, said spring, plurality of washers and plunger being positioned within said internal cavity, said plunger interacting with both said pivoting handle and said spring, said plunger having a range of movement from an open first position to a fully closed second position, said spring positioned to cause said plunger to return to the fully closed second position when the handle is released, said range of movement restricting set screw positioned in the handle in order that it may be adjusted within a range from a first unrestricted position to a second fully restricted position, when the movement restricting set screw is in the first unrestricted position the handle has range of movement permitting maximum pressure up to 70 psi of mixed water when depressed, when the movement restricting set screw is in the second fully restricted position the handle has range of movement permitting maximum pressure up to 0 psi of mixed water when depressed, said self closing valve outlet being sized and shaped in order that said diverter T primary inlet end is fixedly secured therein. A section of standard tubing 10 is used to deliver mixed hot and cold water from the mixing valve 7 to self closing valve 4.

From the foregoing description it will be apparent that modifications can be made to the apparatus without departing from the teaching of the present invention. Accordingly, it is distinctly understood that the invention is not limited to the preferred embodiment but may be embodied and practiced Within the scope of the following claims.

BRIEF DESCRIPTION OF THE DRAWINGS

The object and features of the invention may be understood with reference to the following detailed description of an illustrative embodiment of the invention, taken together with the accompanying drawings in which.

SUMMARY OF THE INVENTION

Figure 1:
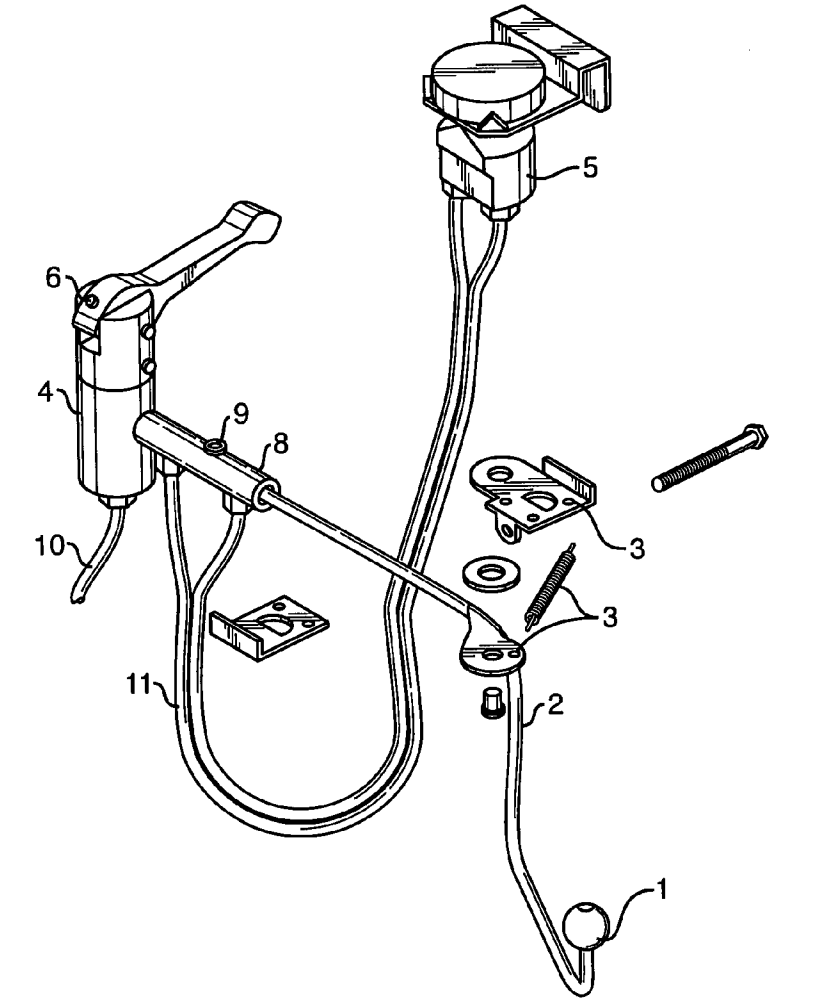
FIG. 1 illustrates an assembled configuration of the present invention, a Bidet. Shown are removable spray nozzle 1, a tubular spray arm 2, a spring activated bracket 3, shown in a disassembled configuration. The spring activated bracket 3 would be mounted to a conventional toilet seat and conventional toilet bowl, that are not shown. Also shown is self closing valve 4 with set screw 6 in the handle, vacuum breaker 5, diverter T 8, injector port 9 on said diverter T, standard tubing 10 that delivers mixed water from mixing valve 7 shown on FIG. 2, and double hose service hose 11.
Figure 2:
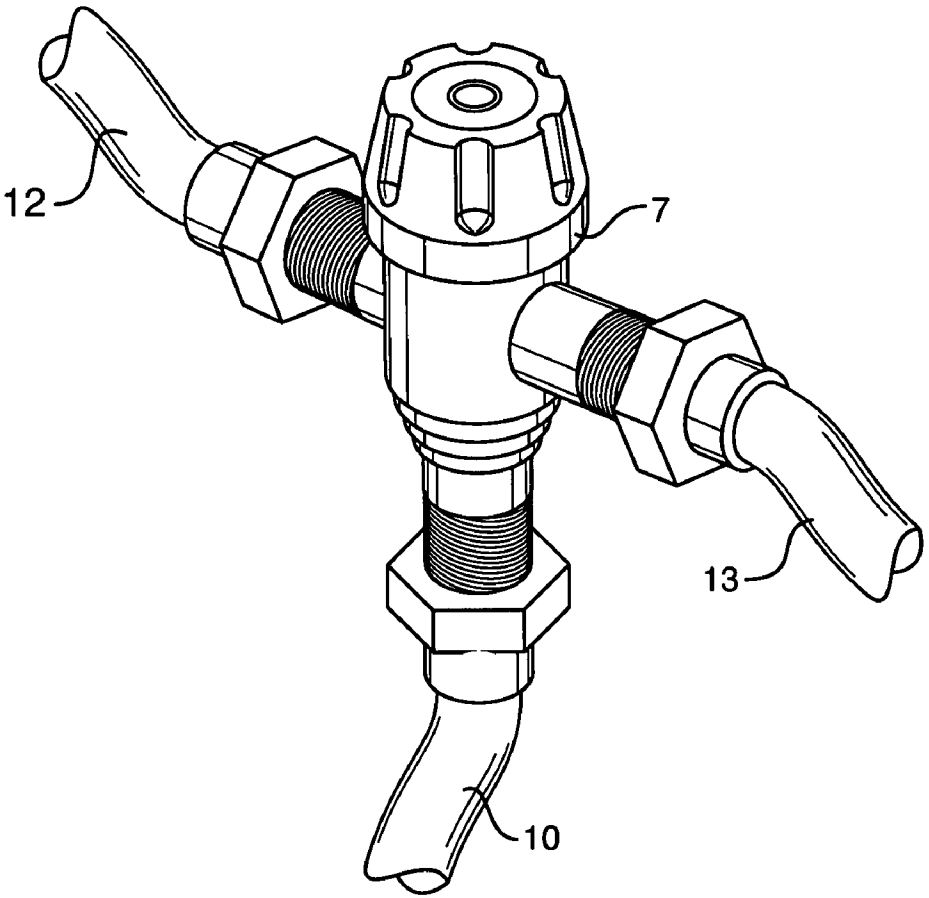
FIG. 2 illustrates mixing valve 7, also shown is standard tubing 10 that delivers mixed water to self closing valve 4 shown in FIG. 1. Also shown are standard hot 12 and cold 13 water lines providing water to the mixing valve 7.
Figure 3:
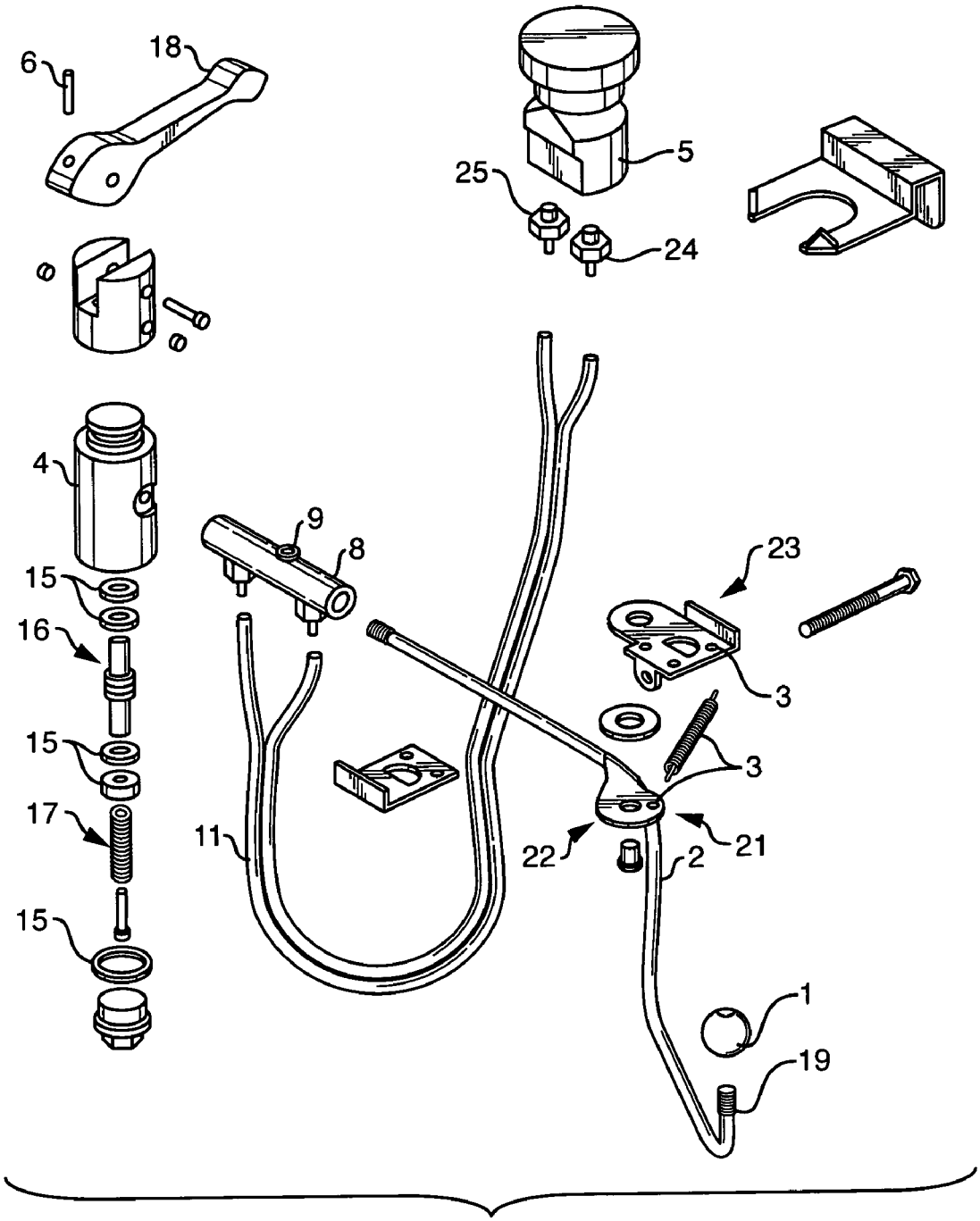
FIG. 3 illustrates the invention in an exploded view. Also shown are washers 15, plunger 16, spring 17 and pivotal handle 18. The tubular spray arm, or tubular member, 2 is shown having a first end 19, a second end 20 and a mid section 21. The spring activated bracket 3 is shown having first bracket 22 and a second bracket 23. The vacuum breaker 5 is shown having an inlet fitting 24 and an outlet fitting 25.
Figure 4:
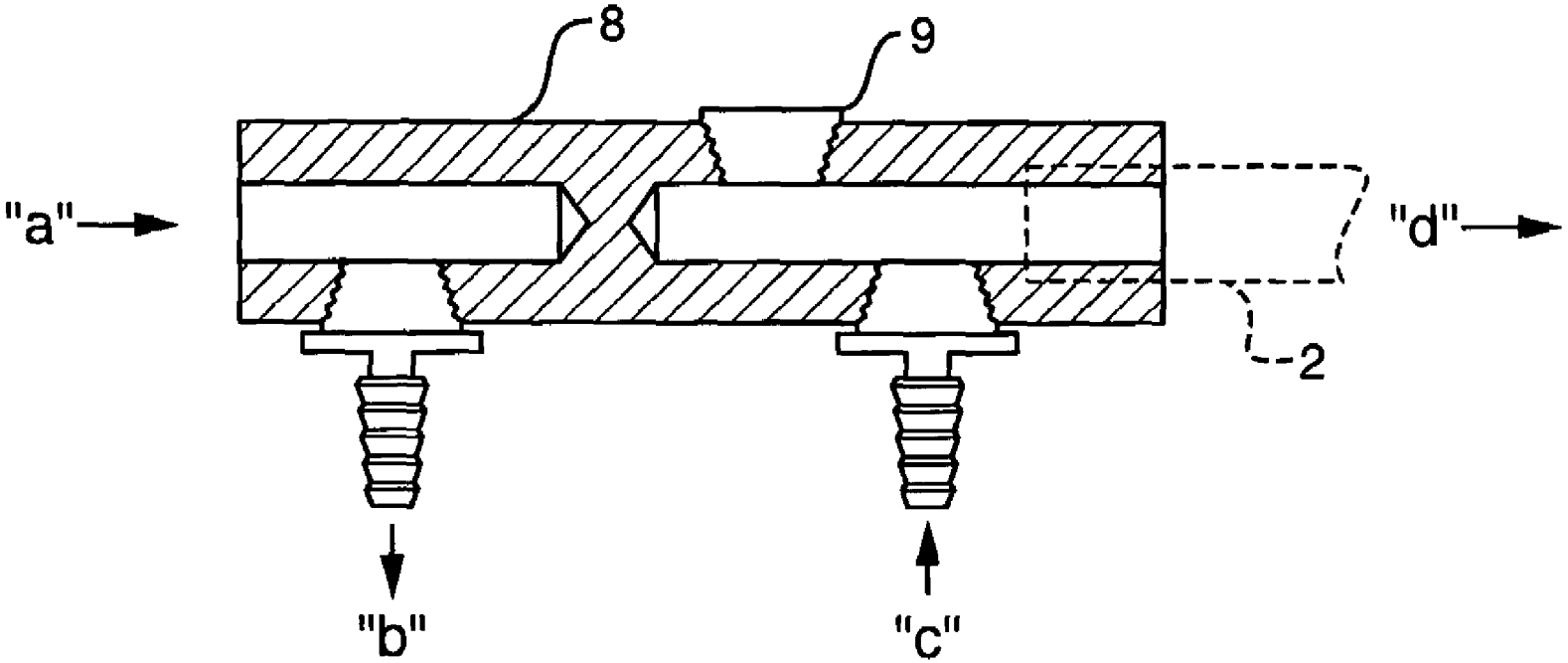
FIG. 4 illustrates a cutaway view of the diverter T 8, indicating that the supply side is separated from the delivery side. Also shown is primary inlet "a" which permits the flow of water from the self closing valve 4, a primary outlet fitting "b" which permits the flow of water to the vacuum breaker 5, a secondary inlet fitting "c" which permits the flow of water back from the vacuum breaker 5, and secondary outlet end "d" which permits the flow to the tubular spray arm 2. In addition the injector port 9 is shown.
Figure 5:
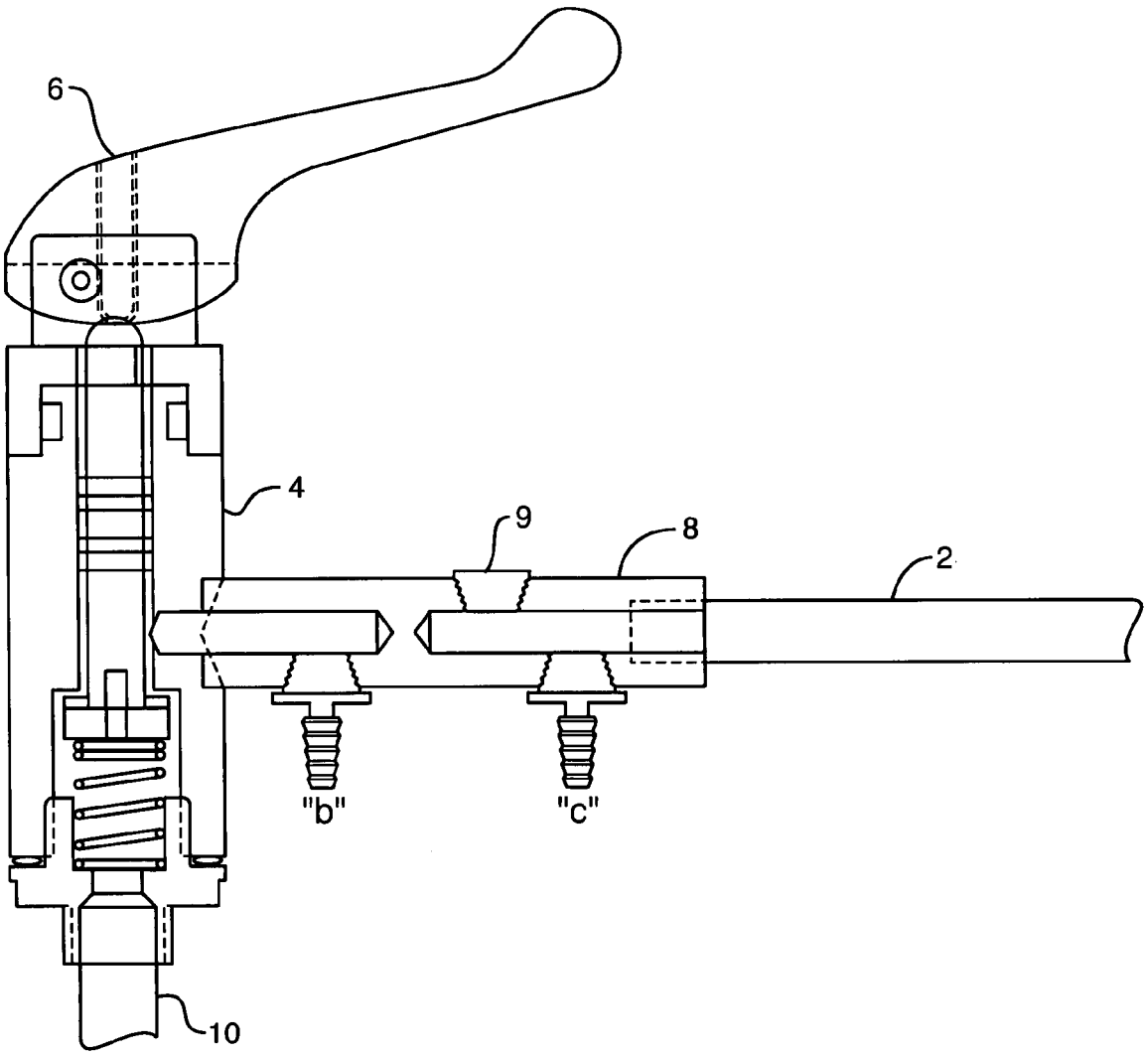
FIG. 5 illustrates cutaway view of both the self closing valve 4 and diverter T 8 indicating how they may be joined together.
Figure 6:
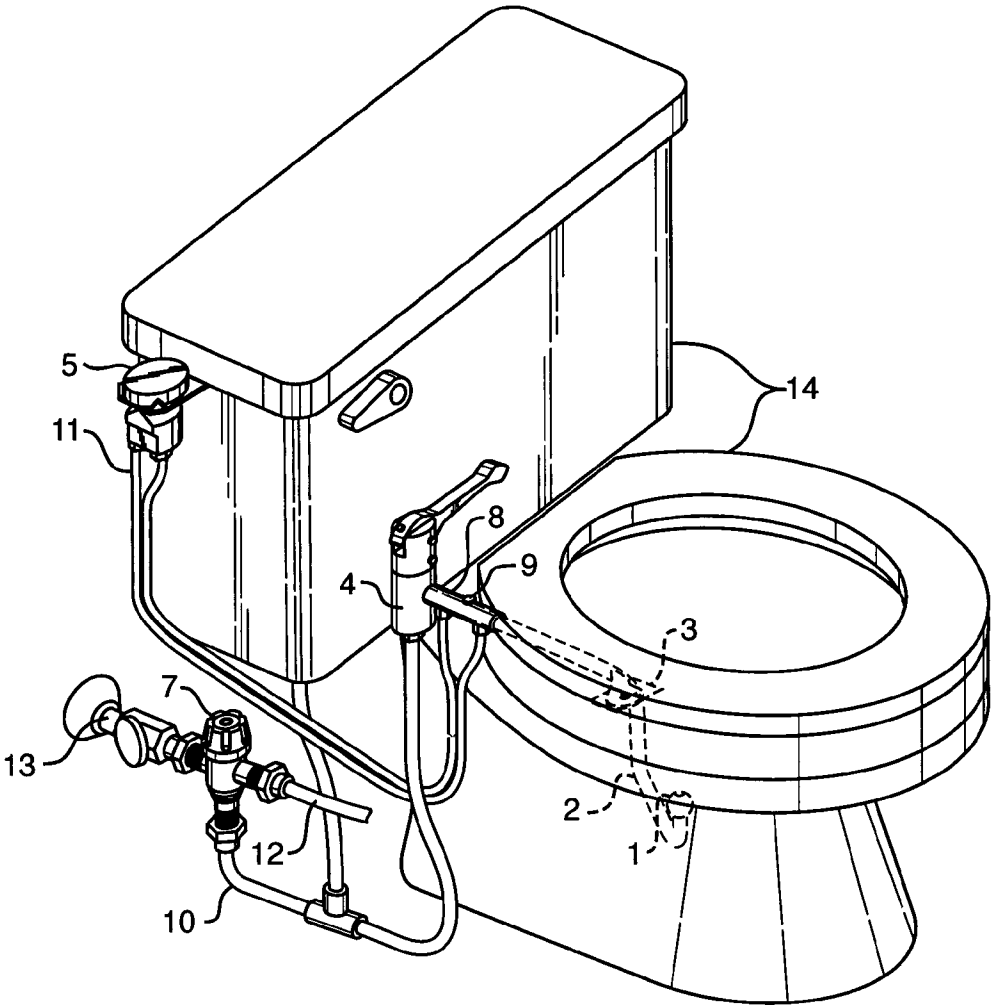
FIG. 6 illustrates the invention showing the bidet, in a fully set up configuration, attached to a toilet bowl and toilet seat 14. The toilet bowl and seat are representative only and not significant. Also shown are removable spray nozzle 1, tubular member 2, spring activated bracket 3, diverter T 8, double hose service hose 11, vacuum breaker 5, self closing valve 4, standard tubing 10, standard mixing valve 7, hot water line 12, cold water line 13 and injection port 9.

The invention portrayed is an improved bidet. There is a need for this device as more and more people have decided to install a bidet in their homes. As a result of growing popularity bidets are now found at hotels, motels, recreation centers and other places people are found relaxing. The present invention is an improvement on existing bidets in that it incorporates several safety and convenience features. The present invention has a variable position removable spray nozzle, means to provide variable pressure of spray, means to provide variable volume of spray, means for mixing input hot water with input cold water to allow for adjustable water temperature within a controlled range, vacuum breaker to prevent water backflow, and a diverter T for selectively adding substances that may be a scented, anti bacterial, medicated or cleansing agent to spray. The diverter T also acts to prevent water backflow.

The invention has a spray nozzle that is removably mounted on a tubular spray arm. The spray arm is pivotally mounted on the rim of a toilet bowl, or on the underside of a conventional toilet seat that is positioned on a conventional toilet bowl, by a spring activated bracket. The spray arm is positioned by the user moving an easily accessible hand operated lever. The spring activated bracket returns the spray arm to an out of the way position under the seat or against the side of the toilet bowl when not in use and the user releases the hand operated lever. The removable spray nozzle allows for cleaning and sanitation of the spray nozzle without any time consuming or complicated procedure. As the spray nozzle is easily removable it is also possible to have several spray nozzles with different spray patterns to accommodate the users individual preference. It also allows for unique requirements due to the individual's personal physical or medical requirements.

The pivotal mounting of the spray arm allows for individual needs or preferences of the user as to spray location or angle. With a spring activated bracket the spray arm and nozzle are quickly and safely removed from the spray area when not in use.

The invention provides for an adjustable spray pressure. The invention as a whole is comprised of elements that will withstand a maximum pressure of 125 psi. For most users the pressure must be well below 125 psi. The invention provides a means that insures that the pressure of the spray will not exceed a maximum safe limit of 70 psi. In some installations the supply line pressure may exceed safe limits for direct skin contact, or may fluctuate and from time to time exceed the safe limit. The present invention incorporates a pressure limiting supply valve. In addition the invention incorporates a volume adjustment that permits the user to adjust and vary the volume to suit the users particular requirements. The pressure and volume adjustments may be incorporated into one element.

The invention includes a spring loaded self closing valve to insure that the flow of water stops when not in use or in the event the user's attention is diverted. A handle allows the user to turn on the flow of water by depressing the handle. The water flow stops when the handle is released and the spring causes the valve to close. A set screw is incorporated into the handle of valve that permits the user to adjust both the maximum pressure and volume.

Water temperature is also of major importance to insure that the users skin is not exposed to water that exceeds safe limits. Most hot water sources have fluctuating temperatures, without proper precautions water at scalding temperatures could be delivered to the spray present invention provides a mixing valve that combines the input hot water with the input cold water to restrict the combined water temperature at no more than 110° F. This limits possibility of injury due to fluctuating temperature of the input hot water. The mixing valve is a readily available off the shelf item.

A vacuum breaker is incorporated to insure that there is no possibility of backflow of the spray water into the water supply. Backflow could carry contaminated water to other outlets in the building or even outside the building, the vacuum breaker prevents any such backflow. The vacuum breaker also insures that water on the spray nozzle side of the vacuum breaker cannot reenter the water supply. The vacuum breaker is a readily available off the shelf item.

Also incorporated is a diverter T that permits the addition of various substances into the spray. The substances would usually be in liquid form however it would be possible to add dissolvable crystals, cubes or gels. The substance, or substances, being added could be scented, anti bacterial, medicated or a cleansing agent. The diverter T also acts to prevent water backflow.

While the invention will be discussed in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

I claim:

1. A bidet providing temperature and volume controlled mixed water, connected to hot water and cold water supply lines, useable with a toilet bowl with toilet seat said toilet bowel and seat having a curvature and an opening, used in combination with a standard mixing valve, said mixing valve being from the group that would restrict the temperature of the mixed water, said mixing valve having a cold water inlet, hot water inlet and an outlet, comprising:

a.) a tubular member having a first end, a second end and a mid section, said tubular member being shaped to accommodate the curvature of said toilet bowel and seat;

b.) a removable spray nozzle sized and shaped to be frictionally secured onto said tubular member first end;

c.) a spring activated bracket said spring activated bracket having a first bracket section fixedly attached to said tubular member mid section, a second bracket section securely attached to said toilet seat, said first bracket section being pivotally positioned with said second bracket section, and a spring with a first end attached to said first bracket section and a second end attached to said second bracket section said spring activated bracket and spring being sized and shaped in order that said tubular member first end may move from a first position, being under said toilet seat when out of use, to a second position, below said toilet seat opening when in use;

d.) a diverter T having a primary inlet end, a primary outlet fitting, an injection port, a secondary inlet fitting and a secondary outlet end, said diverter T secondary outlet end being sized and shaped to be securely attached to said tubular member second end;

e.) a double hose service hose with a first inlet end, a first outlet end, a second inlet end and a second outlet end, said first inlet end sized and shaped to be frictionally secured to said diverter T primary outlet fitting, said second outlet end sized and shaped to be frictionally secured to said diverter T secondary inlet fitting;

f.) a vacuum breaker having an inlet fitting and an outlet fitting, said inlet fitting being sized and shaped to have said double hose service hose first outlet end be frictionally secured thereto, said outlet fitting being sized and shaped to have said double hose service hose second inlet end be frictionally secured thereto;

g.) a self closing valve with an internal cavity, an inlet, an outlet and an activation means, said activation means being a spring, a plurality of washers, a plunger, a pivoting handle, and a range of movement restricting set screw, said pivoting handle may be depressed or released, said spring, plurality of washers and plunger being positioned within said internal cavity, said plunger interacting with both said pivoting handle and said spring, said plunger having a range of movement from an open first position to a fully closed second position, said spring positioned to cause said plunger to return to the fully closed second position when the handle is released, said range of movement restricting set screw positioned in the handle in order that it may be adjusted within a range from a first unrestricted flow position to a second fully restricted no flow position, when the movement restricting set screw is in the first unrestricted flow position the handle has range of movement permitting control up to maximum flow of mixed water when depressed, when the movement restricting set screw is in the second fully restricted, no flow position, the handle has limited range of movement permitting no flow of mixed water when depressed, said self closing valve outlet being sized and shaped in order that said diverter T primary inlet end is fixedly secured therein;

h.) a section of standard tubing with a first end and a second end, said first end being sized and shaped to be fixedly secured to said self closing valve inlet;

i.) said standard mixing valve being of the group that would restrict the temperature range of the mixed water to not exceed a desired temperature, said standard mixing valve outlet being sized and shaped in order that said section of standard tubing second end may be fixedly secured thereto, said standard mixing valve hot water inlet being fixedly secured to a hot water supply line said standard mixing valve cold water inlet being fixedly secured to a cold water supply line; and j.) said temperature and volume controlled mixed water being delivered at the removable spray nozzle.

2. A bidet providing temperature and volume controlled mixed water, connected to hot water and cold water supply lines, useable with a toilet bowl with toilet seat said toilet bowel and seat having a curvature and an opening, used in combination with a standard mixing valve having a cold water inlet, hot water inlet and an outlet, said mixing valve being of the group that would restrict the temperature range of the mixed water to not exceed 110° F. comprising:

a.) a tubular member having a first end, a second end and a mid section, said tubular member being shaped to accommodate the curvature of said toilet bowel and seat;

b.) a removable spray nozzle sized and shaped to be frictionally secured onto said tubular member first end;

c.) a spring activated bracket said spring activated bracket having a first bracket section fixedly attached to said tubular member mid section, a second bracket section securely attached to said toilet seat, said first bracket section being pivotally positioned with said second bracket section, and a spring with a first end attached to said first bracket section and a second end attached to said second bracket section said spring activated bracket and spring being sized and shaped in order that said tubular member first end may move from a first position, being under said toilet seat when out of use, to a second position, below said toilet seat opening when in use;

d.) a diverter T having a primary inlet end, a primary outlet fitting, an injection port, a secondary inlet fitting and a secondary outlet end, said diverter T secondary outlet end being sized and shaped to be securely attached to said tubular member second end;

e.) a double hose service hose with a first inlet end, a first outlet end, a second inlet end and a second outlet end, said first inlet end sized and shaped to be frictionally secured to said diverter T primary outlet fitting, said second outlet end sized and shaped to be frictionally secured to said diverter T secondary inlet fitting;

f.) a vacuum breaker having an inlet fitting and an outlet fitting, said inlet fitting being sized and shaped to have said double hose service hose first outlet end be frictionally secured thereto, said outlet fitting being sized and shaped to have said double hose service hose second inlet end be frictionally secured thereto;

g.) a self closing valve with an internal cavity, an inlet, an outlet and an activation means, said activation means being a spring, a plurality of washers, a plunger, a pivoting handle, and a range of movement restricting set screw, said pivoting handle may be depressed or released, said spring, plurality of washers and plunger being positioned within said internal cavity, said plunger interacting with both said pivoting handle and said spring, said plunger having a range of movement from an open first position to a frilly closed second position, said spring positioned to cause said plunger to return to the fully closed second position when the handle is released, said range of movement restricting set screw positioned in the handle in order that it may be adjusted within a range from a first unrestricted flow position to a second frilly restricted no flow position, when the movement restricting set screw is in the first unrestricted flow position the handle has range of movement permitting control up to maximum flow of mixed water when depressed, when the movement restricting set screw is in the second fully restricted no flow position the handle has limited range of movement permitting no flow of mixed water when depressed, said self closing valve outlet being sized and shaped in order that said diverter T primary inlet end is fixedly secured therein;

h.) a section of standard tubing with a first end and a second end, said first end being sized and shaped to be fixedly secured to said self closing valve inlet;

i.) said standard mixing valve being of the group that would restrict the temperature range of the mixed water to not exceed 110° F., said standard mixing valve outlet being sized and shaped in order that said section of standard tubing second end may be fixedly secured thereto, said standard mixing valve hot water inlet being fixedly secured to a hot water supply line said standard mixing valve cold water inlet being fixedly secured to a cold water supply line; and j.) said temperature and volume controlled mixed water being delivered at the removable spray nozzle.

3. A bidet providing temperature and volume controlled mixed water, connected to hot water and cold water supply lines, useable with a toilet bowl with toilet seat said toilet bowel and seat having a curvature and an opening, used in combination with a standard mixing valve having a cold water inlet, hot water inlet and an outlet, said mixing valve being of the group that would restrict the temperature range of the mixed water to not exceed 110° F. comprising:

a.) a tubular member having a first end, a second end and a mid section, said tubular member being shaped to accommodate the curvature of said toilet bowel and seat;

b.) a removable spray nozzle sized and shaped to be frictionally secured onto said tubular member first end;

c.) a spring activated bracket said spring activated bracket having a first bracket section fixedly attached to said tubular member mid section, a second bracket section securely attached to said toilet seat, said first bracket section being pivotally positioned with said second bracket section, and a spring with a first end attached to said first bracket section and a second end attached to said second bracket section said spring activated bracket and spring being sized and shaped in order that said tubular member first end may move from a first position, being under said toilet seat when out of use, to a second position, below said toilet seat opening when in use;

d.) a diverter T having a primary inlet end, a primary outlet fitting, an injection port, a secondary inlet fitting and a secondary outlet end, said diverter T secondary outlet end being sized and shaped to be securely attached to said tubular member second end;

e.) a double hose service hose with a first inlet end, a first outlet end, a second inlet end and a second outlet end, said first inlet end sized and shaped to be frictionally secured to said diverter T primary outlet fitting, said second outlet end sized and shaped to be frictionally secured to said diverter T secondary inlet fitting;

f.) a vacuum breaker having an inlet fitting and an outlet fitting, said inlet fitting being sized and shaped to have said double hose service hose first outlet end be frictionally secured thereto, said outlet fitting being sized and shaped to have said double hose service hose second inlet end be frictionally secured thereto;

g.) a self closing valve with an internal cavity, an inlet, an outlet and an activation means, said activation means being a spring, a plurality of washers, a plunger, a pivoting handle, and a range of movement restricting set screw, said pivoting handle may be depressed or released, said spring, plurality of washers and plunger being positioned within said internal cavity, said plunger interacting with both said pivoting handle and said spring, said plunger having a range of movement from an open first position to a fully closed second position, said spring positioned to cause said plunger to return to the fully closed second position when the handle is released, said range of movement restricting set screw positioned in the handle in order that it may be adjusted within a range from a first unrestricted flow position to a second fully restricted no flow position, when the movement restricting set screw is in the first unrestricted flow position the handle has range of movement permitting control up to maximum flow of 70 psi of mixed water when depressed, when the movement restricting set screw is in the second fully restricted no flow position the handle has limited range of movement permitting no flow of mixed water when depressed, said self closing valve outlet being sized and shaped in order that said diverter T primary inlet end is fixedly secured therein;

h.) a section of standard tubing with a first end and a second end, said first end being sized and shaped to be fixedly secured to said self closing valve inlet;

i.) said standard mixing valve being of the group that would restrict the temperature range of the mixed water to not exceed 110° F., said standard mixing valve outlet being sized and shaped in order that said section of standard tubing second end may be fixedly secured thereto, said standard mixing valve hot water inlet being fixedly secured to a hot water supply line said standard mixing valve cold water inlet being fixedly secured to a cold water supply line; and j.) said temperature and volume controlled mixed water being delivered at the removable spray nozzle.

* * * * *